US009723929B2

(12) United States Patent
Binfare'

(10) Patent No.: US 9,723,929 B2
(45) Date of Patent: Aug. 8, 2017

(54) PART WITH ADJUSTABLE CONFIGURATION FOR REALIZING ARMRESTS OR BACKRESTS FOR SEATS

(71) Applicant: EDRA S.P.A., Perignano di Lari (PI) (IT)

(72) Inventor: Francesco Binfare', Milan (IT)

(73) Assignee: EDRA S.P.A., Perignano di Lari (IT)

( * ) Notice: Subject to any disclaimer, the term of this patent is extended or adjusted under 35 U.S.C. 154(b) by 0 days.

(21) Appl. No.: 14/782,464

(22) PCT Filed: Apr. 4, 2014

(86) PCT No.: PCT/IB2014/060420
§ 371 (c)(1),
(2) Date: Oct. 5, 2015

(87) PCT Pub. No.: WO2014/162292
PCT Pub. Date: Oct. 9, 2014

(65) Prior Publication Data

US 2016/0037932 A1 Feb. 11, 2016

(30) Foreign Application Priority Data

Apr. 5, 2013 (IT) ..... PI2013A0025

(51) Int. Cl.
*A47C 17/12* (2006.01)
*A47C 7/54* (2006.01)
(Continued)

(52) U.S. Cl.
CPC ..... *A47C 7/543* (2013.01); *A47C 7/38* (2013.01); *A47C 7/402* (2013.01); *A47C 17/04* (2013.01); *A47C 17/12* (2013.01)

(58) Field of Classification Search
CPC ..... A47C 7/543; A47C 7/38; A47C 17/04; A47C 17/12; A47C 7/402
(Continued)

(56) References Cited

U.S. PATENT DOCUMENTS 4,865,387 A * 9/1989 Lipparini ..... A47C 1/023 297/284.1
5,370,443 A * 12/1994 Maruyama ..... B60N 2/2222 297/284.1

FOREIGN PATENT DOCUMENTS

DE 2519189 11/1975
DE 102007002296 7/2008
(Continued)

OTHER PUBLICATIONS

English Abstract of FR 2736250.
(Continued)

*Primary Examiner* — Anthony D Barfield
(74) *Attorney, Agent, or Firm* — Preston Smirman; Smirman IP Law, PLLC

(57) ABSTRACT

The element with variable shape (1) is composed of a cushion (10), having inside a fixed frame (20), which involves a lower section (13) of said cushion (10) and two symmetrical movable frames (25A), (25B), hinged above said fixed frame (20) and aimed at involving an upper section (14) of the cushion (10).
The movable frames (25A), (25B) can rotate by 180° independently from each other, to direct a respective portion (14A), (14B) of said upper section (14) from an external horizontal configuration (HE) to an inner horizontal configuration (HI), passing through a vertical neutral configuration (N), in which the portion (14A), (14B) is substantially aligned with said lower section (13).
(Continued)

The back (100) and sides (110) of a sofa (D) or armchair (P) are defined by respective elements (1), which can be configured in many ways so as to offer the maximum sitting comfort.

12 Claims, 3 Drawing Sheets

(51) Int. Cl.
*A47C 7/38* (2006.01)
*A47C 7/40* (2006.01)
*A47C 17/04* (2006.01)

(58) Field of Classification Search
USPC ..... 297/284.1
See application file for complete search history.

(56) References Cited

FOREIGN PATENT DOCUMENTS

| | | | | |
|---|---|---|---|---|
| DE | 102009040073 | | 4/2010 | |
| DE | 202011001464 | | 4/2011 | |
| FR | 2736250 | | 1/1997 | |
| GB | 259309 A | * | 10/1926 | ..... A47C 7/543 |

OTHER PUBLICATIONS

English Abstract of DE 102009040073.
English Abstract of DE 2519189.
English Abstract of DE 102007002296.
English Abstract of DE 202011001464.

* cited by examiner

PART WITH ADJUSTABLE CONFIGURATION FOR REALIZING ARMRESTS OR BACKRESTS FOR SEATS

TECHNICAL FIELD

The present invention relates to the technical field concerning furniture, with particular reference to armchairs and sofas.

BACKGROUND ART

By definition, armchairs and sofas differ from all other seating furniture, such as chairs, stools, benches and others because they are more comfortable due to big dimensions, soft cushions and ergonomic conformation aimed at allowing a comfortable and relaxing position.

The last condition is important because, as it is known, one can stay sitting in the armchair or on the sofa for long periods, even of many hours, for example, watching TV programs, reading, talking or just relaxing.

It is a well-known fact that, after a certain period of time, the human body needs to modify the assumed position, even the most comfortable, irrespective of the change of the activity performed.

Naturally, the just mentioned need becomes stronger when, though still staying sitting, one changes his activity, for example, from relaxing to reading or to watching a program or something else; as it is obvious, for each of said activities, it can be more comfortable and/or ergonomically correct to change the body position.

In order to improve the comfort, the sofas and armchairs often have supplementary cushions, either provided originally or added at a later time, which can be moved and positioned at will.

Relatively recently, the comfort has been further increased by models of armchairs and sofas available on the market, which are provided with means aimed at changing the seating arrangement, like the car seat, for example, by bigger or smaller inclination of the back and/or seat, forward translation of the seat, shift of the armrests, etc.

Some superior models are equipped also with mechanisms which, on demand, extend a footrest aimed at propping up the legs in almost horizontal position, so that the user assumes half-lying position.

However, the opportunities offered by the above mentioned devices concern 'orthodox' body positions, that is sufficiently straight, whereas, when looking for a comfortable or even only temporarily satisfying position, it is non rare to assume less conventional positions, not very suitable for the normal conformation of backs, sides or armrests which, no matter how soft and pliable they are, must maintain a special profile.

DISCLOSURE OF INVENTION

Technical Problem

Therefore, it is an object of the present invention to propose an element with variable shape for defining backs, sides or armrests of sofas and armchairs, conceived in such a way as to offer a wide choice of configurations to prepare properly so as to follow in best way the position the user is going to assume.

Another object of the invention is to propose an element provided with means aimed at stabilizing each provided configuration, even without the body load, maintaining at the same time a suitable pliability when the body load is applied, so that the element can be shaped according to the shape of the body, all this without perceiving the presence of the inner rigid elements.

A still further object of the invention relates to the will to propose an element, whose conformation can be varied by simple and rapid operations and in which the organs responsible for this constructive characteristic are strong and reliable over time.

A further object of the invention is given by the combined use of more elements with variable shape in the same seating piece of furniture, armchair or sofa, for example to define the back and the lateral sides or armrests, in such a way that a given configuration of one element can successfully match with one or more configurations of the other, so as to increase the range of possible choices.

A still further object of the invention is to propose an element with variable shape obtained by simple and cheap technical solutions, so that the increase of the total cost of a corresponding seating piece of furniture is negligible.

Technical Solution

The above mentioned objects are wholly obtained by an element with variable shape for defining backs, sides or armrests of sofas or armchairs, which comprises:

- a cushion, constituted by an upholstery made of soft material and covered by a flabby covering;
- a fixed frame, housed inside said cushion, made integral with the supporting structure of a sofa or armchair through its lower end, and extended in a nearly vertical direction so as to cross a lower section of the cushion, having an height half the total height of the cushion;
- at least two movable frames, housed inside the cushion in correspondence to an upper section situated above said lower section, with each of the above mentioned movable frames being hinged, independently from the other, at the top of said fixed frame along at least one pivot axis, and being aimed at assuming different positions, each designed to obtain a predetermined configuration of at least one portion of said upper section of the cushion with respect to the lower one;
- movement control means associated to said pivot axes, aimed at locking and unlocking the rotation of the movable frames, in order to enable them to assume said different positions with respect to the fixed frame and to stabilize each assumed position, respectively.

DESCRIPTION OF DRAWINGS

The characteristics of the invention will become clear: from the following description of a preferred embodiment of the element with variable shape under discussion, in accordance with the contents of the claims and with help of the enclosed figures, in which:

MODE FOR INVENTION

Figures 1, 2, 3, 4A, 4B:
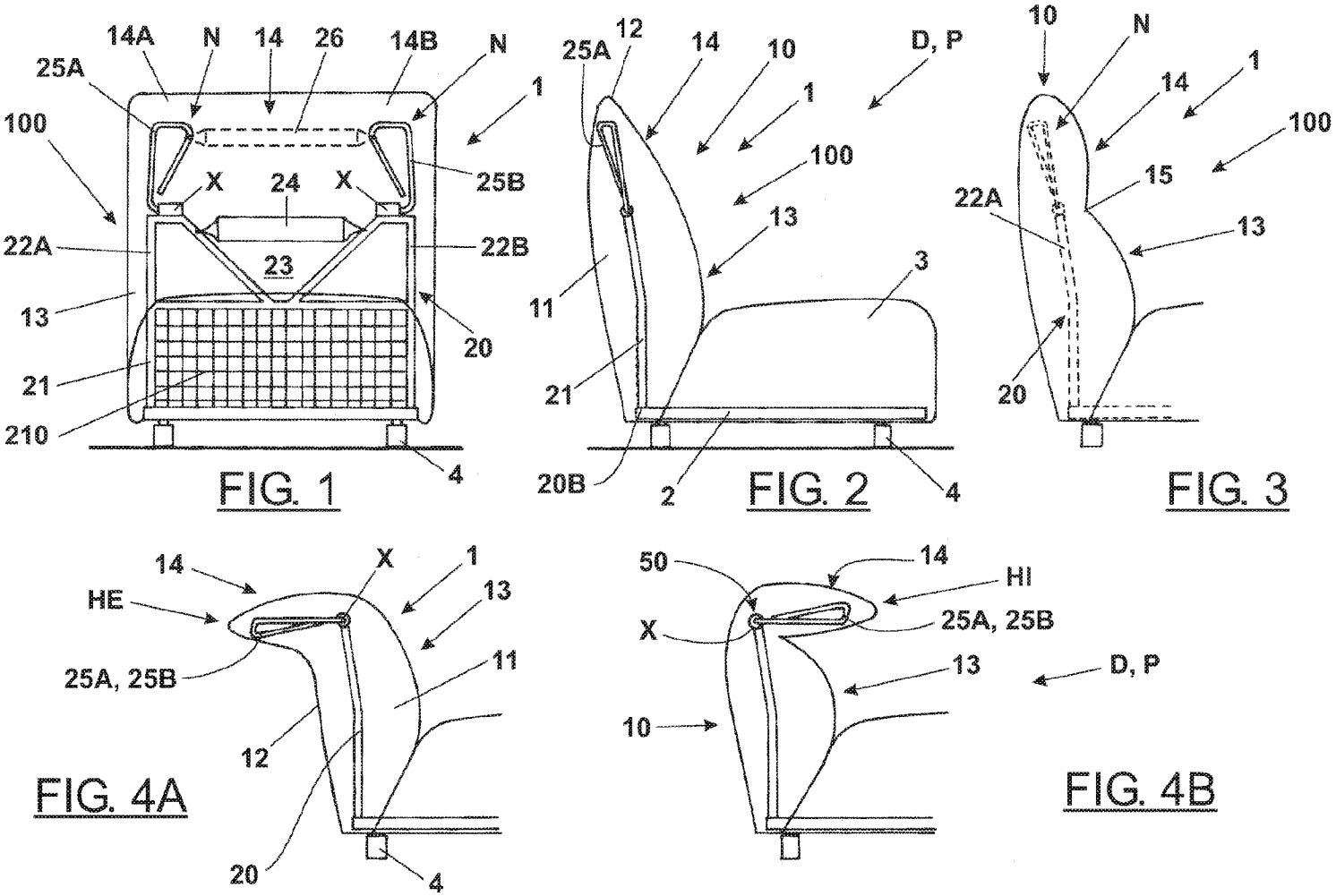
FIG. 1 is a front transparent view of a seating piece of furniture, having the back constituted by the element with variable shape under discussion.
FIG. 2 is a transparent side view of the seating piece of furniture of FIG. 1, with a first profile of the back.
FIG. 3 is a partial side view similar to the one of FIG. 2, with a second profile of the back.
FIG. 4A is a partial side view similar to the one of FIG. 2, with the back inclined outwards.
FIG. 4B is a view similar to the one of FIG. 4A, with the back inclined inwards.

In the above mentioned Figures, the reference numeral 1 indicates the element with variable shape under discussion as a whole.

The element 1, as it will become clear, is aimed at defining sides which can assume a configuration as a back, an armrest or other configurations in sofas D or armchairs P.

As it is known, the difference that distinguishes a back from a lateral side or from an armrest lies substantially in their main function and their positioning with respect to the seat and, in some cases, also in their vertical extension, which is usually smaller in the armrest with respect to the lateral side or to the back.

The enclosed Figures distinguish between backs 100 and sides 110, intended as preferably lateral elements, which can also assume the armrest configuration.

The element 1 includes, in a way known in itself, a cushion 10 made of an upholstery of soft material 11, for example elastic expanded polyurethane (foam rubber) having predetermined characteristics, covered by an external flabby covering 12, for example fabric, synthetic or natural leather and the like.

To make the description simpler, the upholstery 11 is not pointed out in the enclosed Figures, as it is easy to understand.

A fixed frame 20, for example of metallic tube, housed inside the cushion 10 and upholstery 11, is made integral with the supporting structure 2 of a sofa D or armchair P through its lower end, made likewise, for example, of metallic tube and situated at the base of the seat 3 of the same sofa D or armchair P (FIGS. 1, 2).

Known supporting feet 4 are mounted under the supporting structure 2.

The fixed frame 20 extends in a nearly vertical direction so as to extend through a lower section 13 of the cushion 10, having an intermediate height with respect to the total height of the cushion.

The fixed frame 20, in the example shown in the Figures, includes a rectangular frame 21 situated in the lower part, overlapped by a pair of symmetrically disposed arc shaped portions 22A, 22B. A 'V' shaped area 23 is left free between the arc shaped portions.

According to a preferred constructive solution, if the element 1 defines a back 100 (FIG. 1), there is a net 210, for example elastic, situated inside the rectangular frame 21, and an elastic band 24, situated so as to cross said free area 23 to connect the two arc shaped portions 22A, 22B with one each other. Both the net 210 and the elastic band 24 help strengthen the upholstery 11 to efficiently support the back.

The cushion 10 and upholstery 11 house also at least two movable frames 25A, 25B, for example symmetrical, situated in the region of an upper section 14 above said lower section 13. Each of the above mentioned movable frames 25A, 25B is hinged, independently from the other, at the top of the respective arc shaped portion of the fixed frame 20 along at least one pivot axis.

In the illustrated embodiment, each of said movable frames 25A, 25B is situated near a relative side of the cushion 10, is substantially two-dimensional (substantially coplanar with the fixed frame 20 in a neutral configuration N) and extends according to an arched shape, so as to define an open annular profile comprising at least one vertically extending portion (still in the neutral configuration N) near the side of the cushion and e horizontally extending portion near the upper end of the cushion. Each of said movable frames 25A, 25B is hinged along a horizontal axis X, common to the one along which the other movable frame 25A, 25B is hinged.

Each of said movable frames 25A, 25B can rotate, independently from the other and without solution of continuity, from the neutral configuration N, in which it is substantially vertical and aligned with said fixed frame 20, to define an equally vertical configuration of the corresponding portion 14A, 14B of the upper section 14, to an external horizontal configuration HE, to define an outward inclined configuration of the portion 14A, 14B with respect to the mentioned lower section 13, as well as to an internal horizontal configuration HI, to define an inward inclined configuration of the portion 14A, 14B. In particular, when the upper section 14 is in the external horizontal configuration HE (see FIG. 4A), the cushion 10 takes the conventional armrest shape, with the upper section 14 which forms the arm supporting portion.

The rotation of each of said movable frames 25A, 25A, as well as of the corresponding portion 14A, 14B of said upper section 14, between said respective internal horizontal configuration HI and the outer one HE has an angular amplitude of at least 180°, with said neutral configuration N defined almost at the centre of such rotation.

It is to be pointed out that the described configuration of the fixed frame 20, with the arc shaped portions 22A, 22B and the free central area 23, is optimal to facilitate the deformation of the upholstery 11 of the upper section 14, in particular when the two portions 14A, 14B are inclined in opposite directions.

According to a constructive variant, said movable frames 25A, 25B are interconnected by a second elastic band 26, indicated with broken line in FIG. 1, similar to the one connecting said arc shaped portions 22A, 22B, but having lower tensile strength. In fact, said second elastic band 26 must facilitate the re-alignment of said movable frames 25A, 25B without contrasting too much the deformation of said portions 14A, 14B in opposite directions.

Respective movement control means 50, for example friction means, associated to said pivot axes X, are aimed at locking and unlocking the rotation of the movable frames, 25A, 25B, in order to enable them to assume said different positions with respect to the fixed frame 20 and to stabilize each assumed position, respectively.

In particular, adjustment of the above mentioned movement control means 50 is such as to maintain stable each position imposed to the above mentioned movable frames 25A, 25B at least against the stresses deriving from the body load on said upper section 14, however the manual operation of changing the orientation does not require too much effort.

According to a not shown embodiment, said movement control means 50 include a hook shaped member aimed at snap engaging the teeth of a gear wheel, associated with each of said movable frames 25A, 25B coaxial with the respective pivot axis X, in such a way as to lock its rotation, and an unlock rod, connected to an external side of said sofa D or armchair P, which can be operated manually to release said hook shaped member and allow said movable frames 25A, 25B to rotate from one position to another.

The above described element 1 is particularly indicated to define a back 100 with its cushion 10 being anatomically shaped, as shown for example in FIG. 3. Said lower section 13, corresponding to the kidneys supporting area, and the upper section 14, corresponding to the shoulders supporting area, are in this case divided by an inward curve 15, which is advantageous for the rotation of the portions 14A, 14B.

The element 1, as previously said, can form a single part of a seating piece of furniture, such as sofas D or armchairs P, that is the back 100 or lateral side/s 110 or armrest/s as alternative to the latter.

FIGS. 1 to 3 show a modular armchair P, without sides or armrests, which can be placed beside other similar ones. The back 100 of the modular armchair P is defined according to the present invention.

Figure 5:
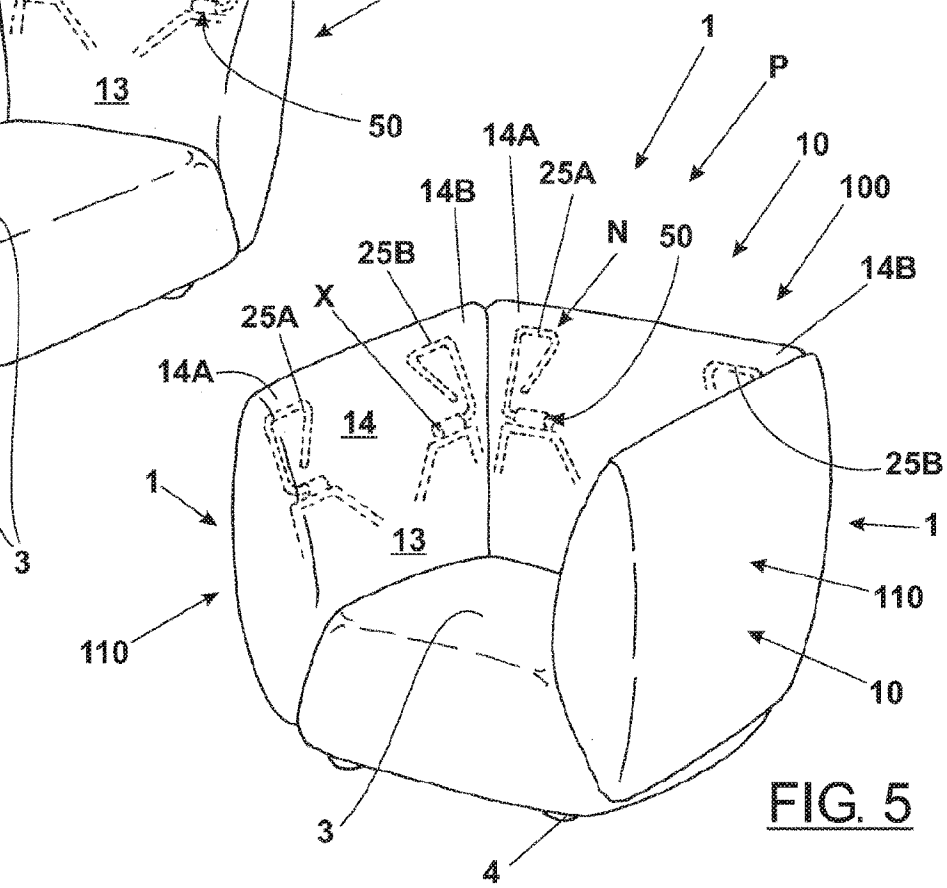
FIG. 5 shows an armchair, whose back as well as lateral sides are defined by the elements according to the invention.
Figure 6:
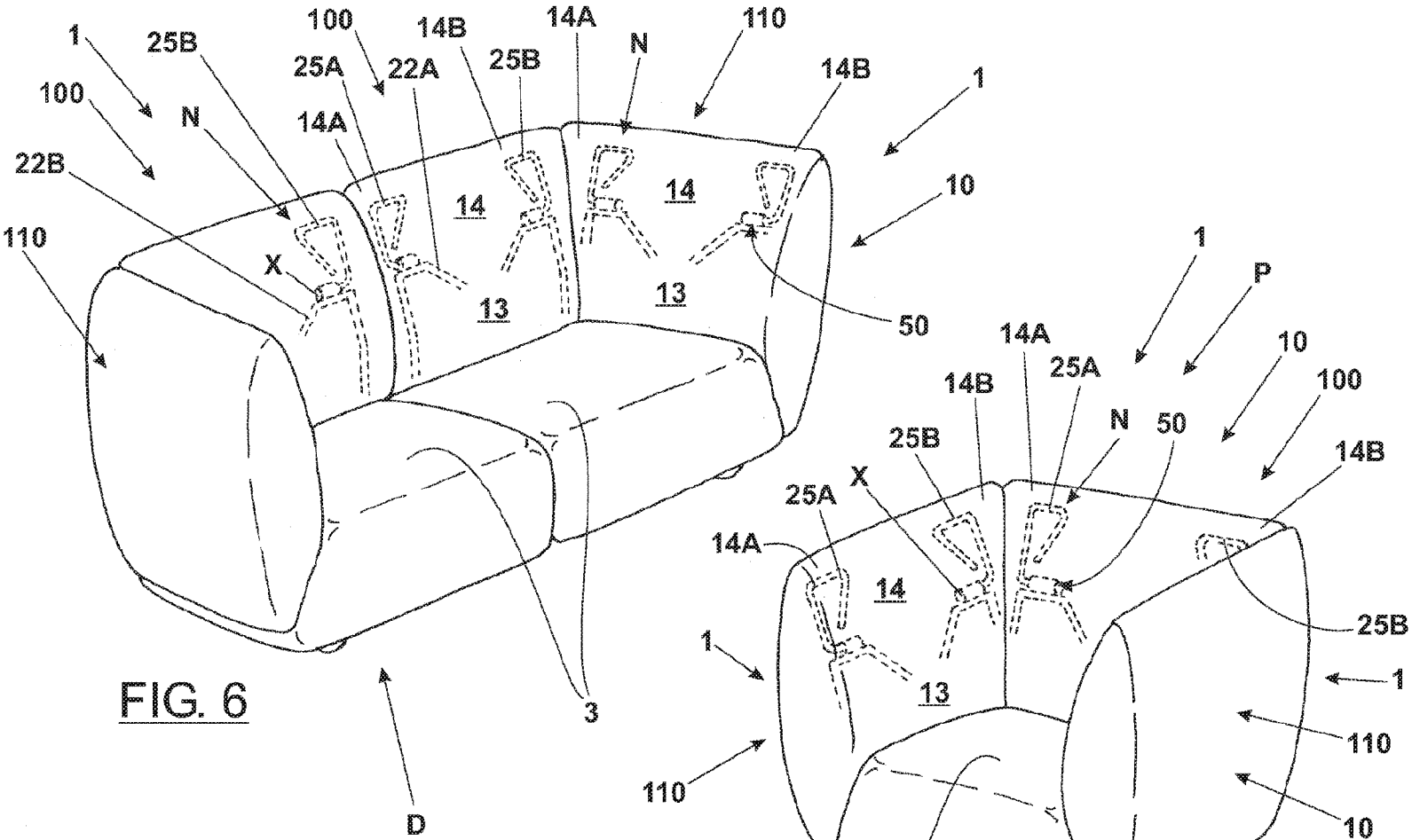
FIG. 6 shows a two-seater sofa, whose backs as well as lateral sides are defined by the elements according to the invention.

FIG. 5 shows an armchair P, the back 100 and sides 110 of which are obtained by the element 1 under discussion; likewise, FIG. 6 shows a sofa D, for example a two-seater one, in which both the independent backs 100 and sides 100 at the ends are made by the element 1.

The last two seating pieces of furniture, due to the characteristics given by the present elements 1, are original with respect to those of the prior art, since the variable configuration of each single element 1 can combine with those of the other elements 1, to determine a plurality of configurations, which can follow and make comfortable the most different body positions.

In order to make more obvious what has just been said, FIGS. 7 to 11 show a seating piece of furniture comprising the back 100 and a lateral side 110, both made of respective elements 1, arranged according to some of the possible configurations; in practice, the just mentioned piece of furniture can be, for example, a half of the sofa D of FIG. 6.

Figure 7:
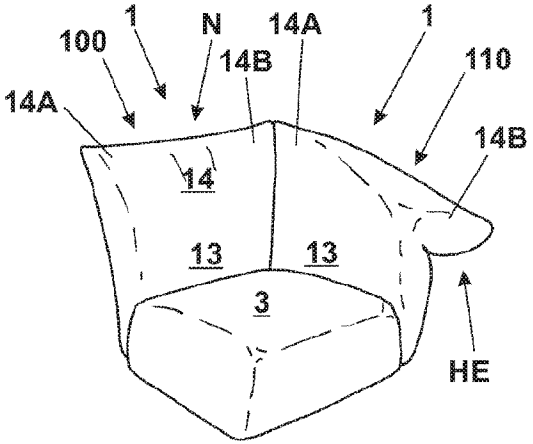

In FIG. 7, the back 100 is in the normal upright position while the lateral side 110 has a portion of the upper section 14 inclined outwards, so as to support an arm; this configuration is suitable for example, for a classical sitting position.

Figure 8:
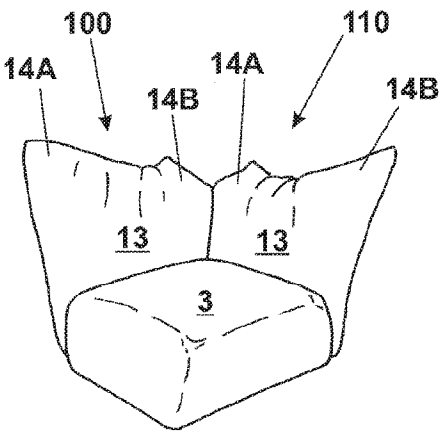

In FIG. 8 both the back 100 and lateral side 110 have adjacent portions of the respective upper sections 14 inclined backwards, in such a way as to constitute a kind of cradle in which the head can be reclined backwards in order to rest.

Figure 9:
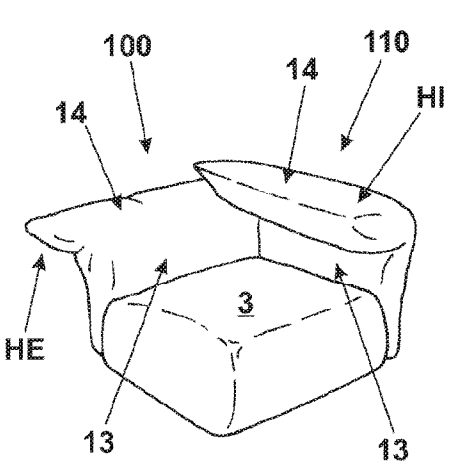
FIGS. 7, 8, 9, 10, 11 show a seating piece of furniture, whose back and one lateral side are defined by the elements according to the invention and are arranged in different combined configurations.

In FIG. 9, the back 100 has its upper section 14 completely inclined backwards (position HE), while the lateral side 110 has its upper section 14 wholly inclined inwards (position HI); this configuration can be suitable for example, for sitting obliquely with the head resting on the lateral side 110, so as to read or watch TV.

Figure 10:
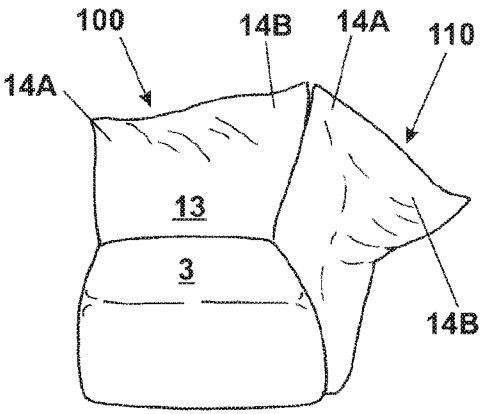

In FIG. 10 both the back 100 and lateral side 110 have adjacent portions of the respective upper sections 14 upright, while the outer portions are inclined outwards; this configuration is suitable for example, for positioning the head between the back 100 and lateral side 110, supporting it in upright position.

Figure 11:
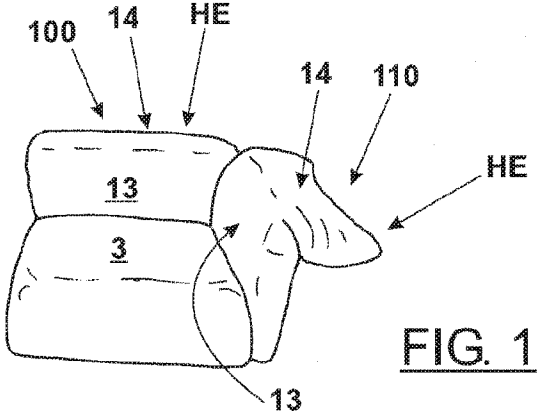

In FIG. 11 both the back 100 and lateral side 110 have the respective upper sections 14 inclined outwards (position HE); this configuration can be suitable for example, for assuming a half lying position, with one or both legs placed on the lateral side 110.

Obviously, other configurations, besides the described ones, are possible, with the portions of each upper section 14 turned in opposite directions; thus, the range of possibilities is very wide and it can certainly allows various positions, even not conventional, in best way.

Furthermore, it is to be pointed out that the versatility of the backs 100 and sides 110 as described above, can be advantageously used also in modular sofas, having seating elements of any form and dimension, arranged also to form corner, curved and island structures, etc. In all the above mentioned types of seating elements, backs 100 and sides 110 can be arranged externally to the seating elements, placing them side by side in sequence or alternating them with free portions of the seating element, thus making the seating piece of furniture extremely versatile.

Moreover, it is to be pointed out that the element with variable shape under discussion is advantageously provided with means which stabilize each configuration without difficult operations for changing it, and without perceiving the presence of the inner rigid elements, once seated.

All the components of the invention are configured in such a way as to present the maximum constructive simplicity, to be strong and reliable over time.

It is understood that what described above is a pure and not limiting example, therefore, possible detail variants which could be necessary for technical and/or functional reasons, are considered from now on within the protective scope defined by the claims below.

The invention claimed is:

1. A system with variable shapes for defining backs, sides or armrests of sofas and armchairs, comprising:

a cushion unit including an upholstery made of soft material and covered by a flexible covering;

a fixed frame located inside the cushion unit and operably associated with, at a lower end thereof, to a supporting structure of the sofa or armchair, the fixed frame extending vertically inside a lower section of the cushion unit and having substantially half a height of the cushion unit;

at least two movable frames, both of the movable frames being located inside the cushion unit in an upper section thereof, and standing above the lower section, each one of the movable frames being independently hinged at a top of the fixed frame about at least one pivot axis and being adapted to independently pivot in a forward direction and a backward direction relative to the fixed frame to reach different positions, each one of the movable frames being operable to obtain a predetermined configuration of at least one portion of the upper section of the cushion unit with respect to the lower section; and a movement control device operably associated with the pivot axis, the device being adapted to allow or to prevent rotation of the movable frames, so as to enable the movable frames to reach the different positions with respect to the fixed frame, or to lock the movable frames in the reached position, respectively.

2. The system according to claim 1, wherein the fixed frame comprises, in the region of its upper portion, a pair of symmetrically disposed arc shaped portions, adapted to define a V-shaped free area between them, wherein the movable frames are hinged at the top of the arc shaped portions.

3. The system according to claim 2, further comprising a first elastic band, arranged to cross the free area and connecting each other the arc shaped portions.

4. The system according to claim 3, further comprising a second elastic band adapted to connect each of the movable frames.

5. The system according to claim 1, wherein each of the movable frames extend so as to define an open annular profile close to a side of the cushion unit itself, and is hinged so as to rotate about an horizontal axis that is the same of the other movable frame.

6. The system according to claim 1, wherein each of the movable frames are selectively operable to oscillate from a neutral configuration, in which it is aligned with the fixed frame in order to define a substantially vertical configuration of the corresponding portion of the upper section, to an external horizontal configuration in order to define an outward directed configuration of the same portion, as well as to an internal horizontal configuration in order to define an inward directed configuration of the same portion.

7. The system according to claim 6, wherein the rotation of each of the movable frames, and of the corresponding portion of the upper section between the internal horizontal configuration and the external configuration covers an angle of at least 180° and in that the neutral configuration is defined at half the rotation angle.

8. The system according to claim 1, wherein the movement control device is of a type operating by friction, being adjusted so as to steadily maintain each position imposed on the movable frames caused by a weight leaning on the upper section.

9. The system according to claim 1, wherein the movement control device comprises a hook shaped member adapted to engage a tooth of a gear wheel operably associated with each of the movable frames coaxial to the pivot axis thereof, so as to lock its rotation, and an unlock rod, that is operated from outside of the sofa or armchair, and selectively operable to disengage the hook shaped member for allowing rotation of the movable frames from one position to another.

10. A piece of furniture including a system with variable shapes for defining backs, sides or armrests of sofas and armchairs according to claim 1.

11. A system with variable shapes for defining backs, sides or armrests of sofas and armchairs, comprising:

a cushion including an upholstery made of soft material and covered by a flexible covering;

a fixed frame located inside the cushion and operably associated with, at a lower end thereof, to a supporting structure of the sofa or armchair, the fixed frame extending vertically inside a lower section of the cushion and having substantially half a height of the cushion;

at least two movable frames located inside the cushion in an upper section thereof, and standing above the lower section, each one of the movable frames being independently hinged at a top of the fixed frame about at least one pivot axis and being adapted to pivot in a forward direction and a backward direction relative to the fixed frame to reach different positions, each one operable to obtain a predetermined configuration of at least one portion of the upper section of the cushion with respect to the lower section; and a movement control device operably associated with the pivot axis, the device being adapted to allow or to prevent rotation of the movable frames, so as to enable the movable frames to reach the different positions with respect to the fixed frame, or to lock the movable frames in the reached position, respectively;

wherein the fixed frame comprises, in the region of its upper portion, a pair of symmetrically disposed arc shaped portions, adapted to define a V-shaped free area between them, wherein the movable frames are hinged at the top of the arc shaped portions.

12. A system with variable shapes for defining backs, sides or armrests of sofas and armchairs, comprising:

a cushion including an upholstery made of soft material and covered by a flexible covering;

a fixed frame located inside the cushion and operably associated with, at a lower end thereof, to a supporting structure of the sofa or armchair, the fixed frame extending vertically inside a lower section of the cushion and having substantially half a height of the cushion;

at least two movable frames located inside the cushion in an upper section thereof, and standing above the lower section, each one of the movable frames being independently hinged at a top of the fixed frame about at least one pivot axis and being adapted to pivot in a forward direction and a backward direction relative to the fixed frame to reach different positions, each one operable to obtain a predetermined configuration of at least one portion of the upper section of the cushion with respect to the lower section; and a movement control device operably associated with the pivot axis, the device being adapted to allow or to prevent rotation of the movable frames, so as to enable the movable frames to reach the different positions with respect to the fixed frame, or to lock the movable frames in the reached position, respectively;

wherein the movement control device comprises a hook shaped member adapted to engage a tooth of a gear wheel operably associated with each of the movable frames coaxial to the pivot axis thereof, so as to lock its rotation, and an unlock rod, that is operated from outside of the sofa or armchair, and selectively operable to disengage the hook shaped member for allowing rotation of the movable frames from one position to another.

* * * * *